United States Patent [19]

Jayasinghe et al.

[11] Patent Number: 4,462,807

[45] Date of Patent: Jul. 31, 1984

[54] METHOD OF DECHLORINATING COAL

[75] Inventors: Sarath S. Jayasinghe; Michael A. Hooker; Denis H. T. Spencer, all of Cheltenham, England

[73] Assignee: Coal Industry (Patents) Limited, London, England

[21] Appl. No.: 400,354

[22] Filed: Jul. 21, 1982

[30] Foreign Application Priority Data

Sep. 19, 1981 [GB] United Kingdom ..... 8128318

[51] Int. Cl.[3] ..... C10L 9/02

[52] U.S. Cl. ..... 44/1 R; 423/461

[58] Field of Search ..... 44/1 R, 1 SR, 1 B; 201/17; 423/460, 461; 241/1

[56] References Cited

U.S. PATENT DOCUMENTS

| | | | |
|---|---|---|---|
| 2,793,172 | 5/1957 | Smith et al. | 201/17 X |
| 3,214,346 | 10/1965 | Mason et al. | 423/461 X |
| 3,393,978 | 7/1968 | Murphy et al. | 201/17 X |
| 3,536,512 | 10/1970 | Deery, Jr. | 423/460 X |
| 4,032,193 | 6/1977 | Drinkard et al. | 44/1 B |
| 4,081,250 | 3/1978 | Hsu et al. | 44/1 SR |
| 4,169,710 | 10/1979 | Jensen | 44/1 SR |
| 4,325,707 | 4/1982 | Kalvinskas et al. | 44/1 SR |

*Primary Examiner*—Carl F. Dees

*Attorney, Agent, or Firm*—Stevens, Davis, Miller & Mosher

[57] ABSTRACT

This invention relates to a method of dechlorinating coal, which comprises treating washery-processed coal having a particle size from 1 to 12 mm with aqueous ammonia having a concentration from 1 to 18 M for from 3 to 25 hours.

The invention will be of use in the preparation of coal for coal utilization plants so that the coal is less likely to cause corrosion.

8 Claims, 1 Drawing Figure

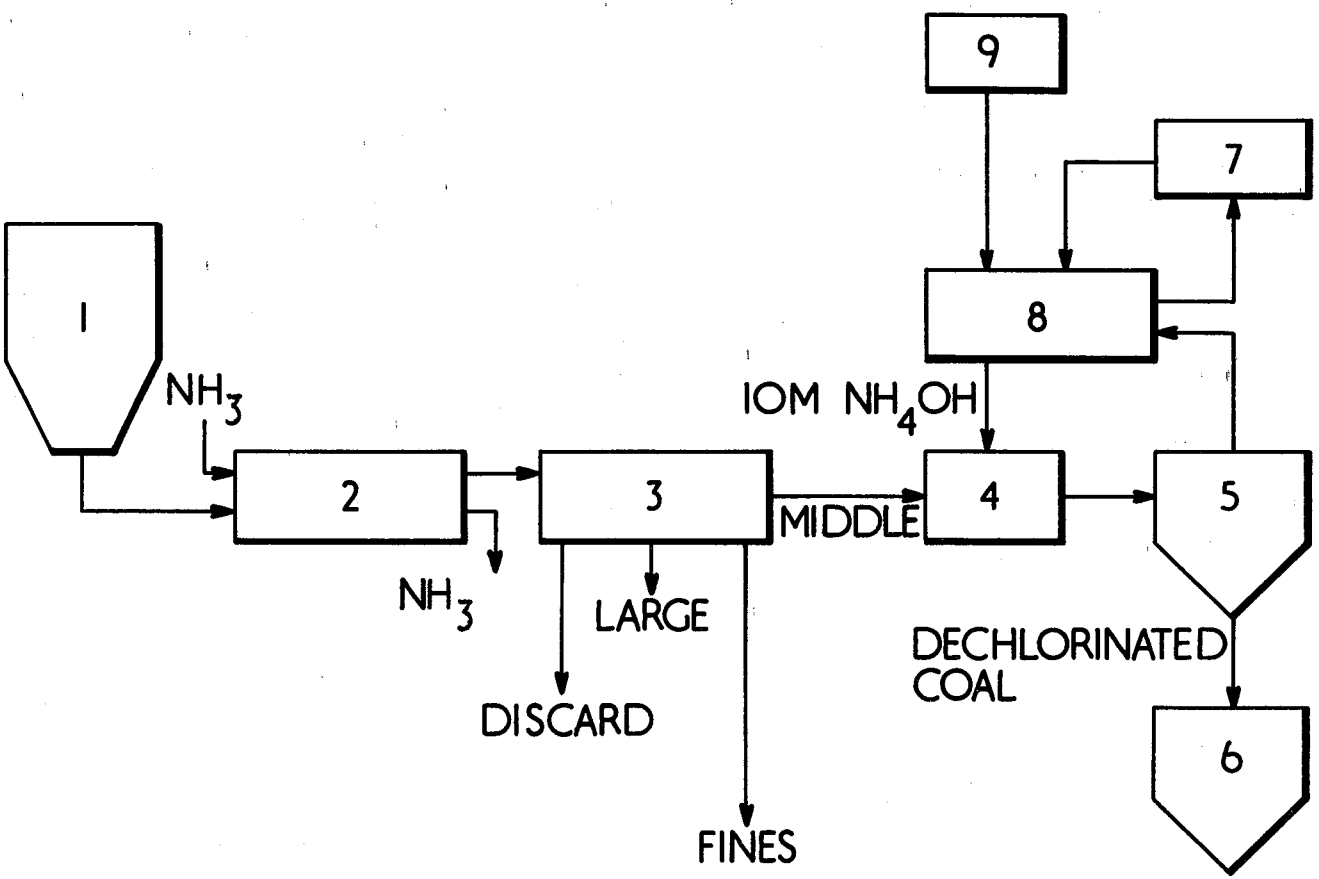
1
NH3
2
NH3
3
LARGE
DISCARD
FINES
MIDDLE
IOM NH4OH
4
5
DECHLORINATED COAL
6
7
8
9

METHOD OF DECHLORINATING COAL

This invention relates to a method of cleaning coal, and in particular relates to a method of improving the properties of a coal material after it has been separated from the majority of its contaminants is a colliery washery.

After coal has been removed from the mine, it is treated in a washery to separate it from the rock debris and ash which is inevitably mined with it. However even after treatment in a washery, coal still contains impurities which can present problems in its use. For instance, coal containing high amount of chlorine (i.e. over 0.4%w/w d.a.f.) are not acceptable as fuels for power stations because they cause problems of corrosion in the power station plant. It is an object of the present invention to provide a method of treating at least some high chlorine coals so that they may be used in power station without causing corrosion problems.

Therefore according to the present invention, there is provided a method of cleaning coal comprising treating wash coal having a particle size from 1 to 12 mm and a chlorine content above 0.4%w/w d.a.f. with aqueous ammonia having a concentration from 1 to 18M for from 3 to 25 hours.

It is known that certain coals which have high chlorine contents will not be susceptible to this treatment. It is not fully understood why this should be, athough it is a matter of simple experimentation to determine which coals will be susceptible to this treatment. It is assumed that the coals which are not susceptible to this treatment have distinctly differenct structures to those that are.

Much work has been carried out, mainly in the United States, on the chemical communication of coal. Coal either in situ before it is mined, or in large lumps form before it is washed is treated for periods up to about 3 hours with liquid or gasous anhydrous ammonia or with aqueous solutions of bases such as amines and sodium hydroxide. These processes are described in for instance U.S. Pat. Nos. 3,815,826, 3,870,237 and 4,032,193. In particular, the latter patent describes the use of aqueous bases for chemical comminution and suggests that ammonia might be used. However there are no practical examples of the use of aqueous ammonia. Moreover, the treatment is for a short time and is used to comminute lump coal. The Applicants believe that this process would not result in any significant reduction in the chlorine content of the coal material. The described process has as its purpose the facilitation of removing mineral matter from the coal by a physical process. This is in essence the practice completely different to the treatment according to the present invention.

In the present treatment, it is necessary to have a fairly small top size for the coal (12 mm) in order that effective extraction of the chlorine from the coal can take place. Similarly if there is a significant amount of fine material (less than 1 mm) in the coal, there are difficulties in processing the material and the fines may interfere with the extraction of chlorine from the larger coal. Preferably about 90% of the coal is in the size range 3–6 mm.

The maximum concentration of the ammonia solution is set at 18M to obviate the necessity of using superatmospheric pressure. However, it is not necessary to use such concentrated solutions and a IOM solution is preferred for practical purposes. This enables an efficient extraction to take place over a reasonable period of time. Preferably about 5 parts (by weight) of ammonia solution are used to treat one part of the washed coal.

For an ammonia solution of approximately IOM concentration, it is thought that a treatment time of about 8 hours will be sufficient. However, in practical operations it will be necesary to determine experimentally the exact treatment time taking into account the concentration of the solution, the structure of the coal and its physical state. As a general rule it will be necessary to increase the time of treatment as the concentration of the ammonia solution decreases. In any case the treatment time will be very much greater than is needed to cause comminution of unwashed coal.

The treated coal may be removed from the solution by any convenient means, for instance decantation. However it is preferred to effect the separation by certifugation as this will to a large extent ensure that any solution trapped in the coal pores is removed. After this step the coal will be able to put to immediate use as a power station fuel.

Before it is treated, the coal must be washed and sized. Since run-of-mine coal has a top size of about 150 mm, it will be necessary to crush the coal. This may be carried out by mechanical or chemical means. Preferably, the coal is chemically comminuted as this results in less fine material will therefore present less problem in the further processing stages. After comminution and the coal will need to be washed and sized in conventional manner.

After treatment, the ammonia solution will need to be regenerated by removing from it the impurities leached out of the coal. These will be mainly chlorine ions, although other impurities especially ionic species, will also be leached out by the treatment. The ammonia solution is preferably regenerated by a reverse osmosis process, although any other conventional regeneration process may be used. During regeneration a portion of the ammonia may be lost, and it will therefore be necessary to have a supply of concentrated ammonia present in order to fortify as necessary the recycled ammonia solution.

It is envisaged that the treatment according to the invention will be one of a series of stages in a colliery washery, although it could be carried out at a site including the power station or other plant in which the coal is to be utilized. It is thought that the treated coal may also be used for instance in preparation of high quality carbon electrodes where it is desirable to have as low a content of impurities as possible.

The present invention will now be described, by way of example only with reference to the accompanying drawing, which shows diagrammatically a coal preparation plant including a treatment stage operated according to the present invention.

The coal preparation plant shown in the drawing, to which reference is now made, comprises a bunker 1 in which is stored run-of-mine coal. The coal in the bunker will comprise anything from 0 to 30%w/w mineral matter, and will have a size from 0 to 150 mm or in some cases larger. The coal from the bunker 1 is fed to a comminuter 2 in which it is mixed with anhydrous liquid ammonia according to the known processes described previously. After up to about 1 hour the coal and the ammonia are separated and the comminuted coal is fed to a washery 3. The washery 3 comprises a number of treatment stages, all of which are known in the art, including screens, flitation baths and washboxes.

The washery 3 is set to operate so that it produces four fractions being a discard fraction containing non-coal minerals and other contaminants introduced during mining, a large coal fraction containing all coal above 6 mm in size, a middle fraction containing all coal in the size range from 3–6 mm, and a fines fraction containing aal coal of a size less than 1 mm.

The middle fraction from the washery 3 is fed to a treatment stage 4 wherein it is mixed with a 10M solution of ammonia in a ratio of 5 parts of solution to 1 part of coal. The mixture is gently agitated for about 8 hours whereupon it is fed to a centrifugal separator 5. The treatment may be operated in a continuous manner or may be operated in a series of batch operations depending on the equipment available at the plant.

The centrifuge 5 separates the solids from the liquid and produces a stream of liquid from its top and a coal fraction which is collected in a hopper 6. The coal fraction can then be transported, for instance, to a power station for burning.

The liquid stream may be recycled directly to the treatment stage 4 or may be passed to a reverse osmosis stage 7 for regeneration. The quality of the stream will be constantly monitored by instrumentation 8 which detects the amount of impurity in the stream and the concentration of the ammonia. The instrumentation 8 controls the flow of the stream so that it can be either recycled or regenerated and also controls a make-up solution feed 9 which is used to ensure that the recycling ammonia solution is of the correct concentration.

In a test program coal from Lea Hall Colliery was treated in an experimental rig which simulated the operation of a plant as described above. The run-of-mine coal had an ash content of about 20% and had a chlorine content of 0.63% (daf). After treatment the chlorine content of the 3–6 mm fraction of the coal was 0.1% (daf). Thus the treatment produced a coal suitable for use in a power station from a coal which would, if used untreated, have caused corrosiion problems in the boilers of the power station. In a similar trial coal from the Hem Heath Colliery was treated according to the invention. This coal had an entirely different morphology to that of the Lea Hall coal and it was found that even on prolonged exposure to aqueous ammonia, little reduction in chlorine content could be achieved.

Thus the present invention is of use in cleaning suitable coals to enable them to be used in applications where high chlorine content would be a problem.

We claim:

1. A method of dechlorinating coal comprising treating washery-processed coal having a particle size up to 12 mm with aqueous ammonia having a concentration from 1 to 18 M for from 3 to 25 hours.

2. A method according to claim 1, wherein the treatment is carried out at ambient temperature.

3. A method according to claim 1, wherein 90% of the coal in in the size range 1–12 mm.

4. A method according to claim 1, wherein the concentration of the ammonia solution is about 10M.

5. A method according to claim 4, wherein the treatment time is about 8 hours.

6. A method according to claim 1, and including the step of separating the coal from the solution at the end of the treatment time.

7. A method according to claim 1, and including a solution regeneration step.

8. A method of dechlorinating coal comprising:

mixing comminuted coal having a particle size up to about 12 mm with an aqueous ammonia solution having a concentration from 1 to 18 M in a ratio of about 5 parts of solution to one part of coal;

agitating the mixture for 3 to 25 hours; and centrifuging the mixture to separate the solids from the liquid.

* * * * *